US011845630B2

(12) United States Patent
Oike

(10) Patent No.: US 11,845,630 B2
(45) Date of Patent: Dec. 19, 2023

(54) IMAGE FORMING APPARATUS

(71) Applicant: CANON KABUSHIKI KAISHA, Tokyo (JP)

(72) Inventor: Masayuki Oike, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 438 days.

(21) Appl. No.: 16/733,512

(22) Filed: Jan. 3, 2020

(65) Prior Publication Data

US 2020/0239254 A1 Jul. 30, 2020

(30) Foreign Application Priority Data

Jan. 30, 2019 (JP) ..... 2019-014163

(51) Int. Cl.
*B65H 7/04* (2006.01)
*B65H 1/26* (2006.01)
*B65H 5/26* (2006.01)

(52) U.S. Cl.
CPC ..... *B65H 7/04* (2013.01); *B65H 1/266* (2013.01); *B65H 5/26* (2013.01)

(58) Field of Classification Search
CPC . B65H 7/04; B65H 1/266; B65H 5/26; B65H 2405/332
See application file for complete search history.

(56) References Cited

U.S. PATENT DOCUMENTS 4,966,356 A * 10/1990 Ohyabu ..... B65H 1/266 271/9.11
5,155,537 A * 10/1992 Komatsu ..... B65H 1/04 271/9.02
9,561,920 B1 * 2/2017 Wilsher ..... B65H 7/20
2002/0020961 A1 * 2/2002 Gibson ..... B65H 1/266 271/256

(Continued)

FOREIGN PATENT DOCUMENTS

JP 2000-62985 A 2/2000
JP 2002-068526 A 3/2002
JP 2011-168382 A 9/2011

OTHER PUBLICATIONS

Machine translation of JP2011-168382. (Year: 2011).*
Japanese Office Action dated Feb. 28, 2023, in related Japanese Patent Application No. 2019-014163.

*Primary Examiner* — Thomas A Morrison
(74) *Attorney, Agent, or Firm* — VENABLE LLP

(57) ABSTRACT

An image forming apparatus includes a first feeding portion including a first cassette and a first feed roller; and a second feeding portion including a second cassette and a second feed roller and disposed below the first feeding portion. The sheet fed by the second feed roller is conveyed toward an image forming portion through an intermediate path provided in the first cassette. The image forming apparatus further includes a controller to operate a display unit to display information that inhibits drawing of the first cassette, in a case where a first detection portion detects that the first cassette is empty and where the second feeding portion is (Continued)

performing a sheet feeding operation, with the first cassette being drawable from the apparatus body whether the second feeding portion is performing a sheet operation or not.

15 Claims, 13 Drawing Sheets

(56) References Cited

U.S. PATENT DOCUMENTS

| | | | | |
|---|---|---|---|---|
| 2011/0218669 | A1* | 9/2011 | Matsumoto | B65H 5/26 700/214 |
| 2013/0009359 | A1* | 1/2013 | Yamada | B65H 5/26 271/264 |
| 2014/0089840 | A1* | 3/2014 | Nakagawa | G06F 3/04847 715/810 |
| 2015/0145198 | A1* | 5/2015 | Sakata | B65H 3/34 271/9.02 |

* cited by examiner

IMAGE FORMING APPARATUS

BACKGROUND OF THE INVENTION

Field of the Invention

The present invention relates to an image forming apparatus that feeds a sheet and forms an image on the fed sheet.

Description of the Related Art

Image forming apparatuses such as printers, copying machines, and multifunction printers feed a sheet, which is a recording medium, from a feeding cassette, form an image on the sheet, and outputs the sheet. In a known image forming apparatus having a plurality of feeding cassettes that can be drawn from an apparatus body, a sheet fed from one feeding cassette is conveyed through a sheet conveyance path formed in another feeding cassette. In this configuration, if the other feeding cassette is drawn during the conveyance of the sheet, the sheet conveyance path will be cut off, possibly causing sheet jam. Japanese Patent Application Publication No. 2000-062985 describes a technique in which when a sheet is fed from a lower sheet feeding tray, an upper sheet feeding tray is locked by a lock mechanism for preventing the upper sheet feeding tray from being drawn.

However, the technique described in the above-described document needs at least a member to lock a sheet feeding tray and an actuator to move the member, both of which constitute the lock mechanism. Thus, the technique will complicate the configuration of the apparatus and increase the manufacturing costs. In addition, if the lock mechanism fails, a user might draw the upper sheet feeding tray while a sheet is fed from the lower sheet feeding tray.

SUMMARY OF THE INVENTION

The present invention provides an image forming apparatus including a new configuration for suppressing occurrence of sheet jam.

According to one aspect of the invention, an image forming apparatus includes: an apparatus body provided with an image forming portion configured to form an image on a sheet; a first feeding portion including a first cassette configured to be drawable from the apparatus body and a first feed roller configured to feed a sheet stored in the first cassette toward the image forming portion; a second feeding portion disposed below the first feeding portion and including a second cassette configured to be drawable from the apparatus body and a second feed roller configured to feed a sheet stored in the second cassette, the sheet fed by the second feed roller being conveyed toward the image forming portion through an intermediate path provided in the first cassette; a first detection portion configured to detect an amount of remaining sheets stored in the first cassette; a display unit configured to display information; and a controller configured to operate the display unit to display information that inhibits drawing of the first cassette, in a case where the first detection portion detects that the first cassette is empty and where the second feeding portion is performing a sheet feeding operation.

According to another aspect of the invention, an image forming apparatus includes: an apparatus body provided with an image forming portion configured to form an image on a sheet; a first feeding portion including a first cassette configured to be drawable from the apparatus body and a first feed roller configured to feed a sheet stored in the first cassette toward the image forming portion; a second feeding portion disposed below the first feeding portion and including a second cassette configured to be drawable from the apparatus body and a second feed roller configured to feed a sheet stored in the second cassette, the sheet fed by the second feed roller being conveyed toward the image forming portion through an intermediate path provided in the first cassette; a first detection portion configured to detect an amount of remaining sheets stored in the first cassette; a display unit configured to display information; and a controller configured to operate the display unit to display information on the amount of remaining sheets stored in the first cassette, depending on a detection result by the first detection portion, wherein the controller is configured to restrict the display unit to display the information on the amount of remaining sheets stored in the first cassette while the second feeding portion is performing a sheet feeding operation.

Further features of the present invention will become apparent from the following description of exemplary embodiments with reference to the attached drawings.

DESCRIPTION OF THE EMBODIMENTS

Hereinafter, exemplary embodiments of the present invention will be described with reference to the attached drawings.

Figure 1:
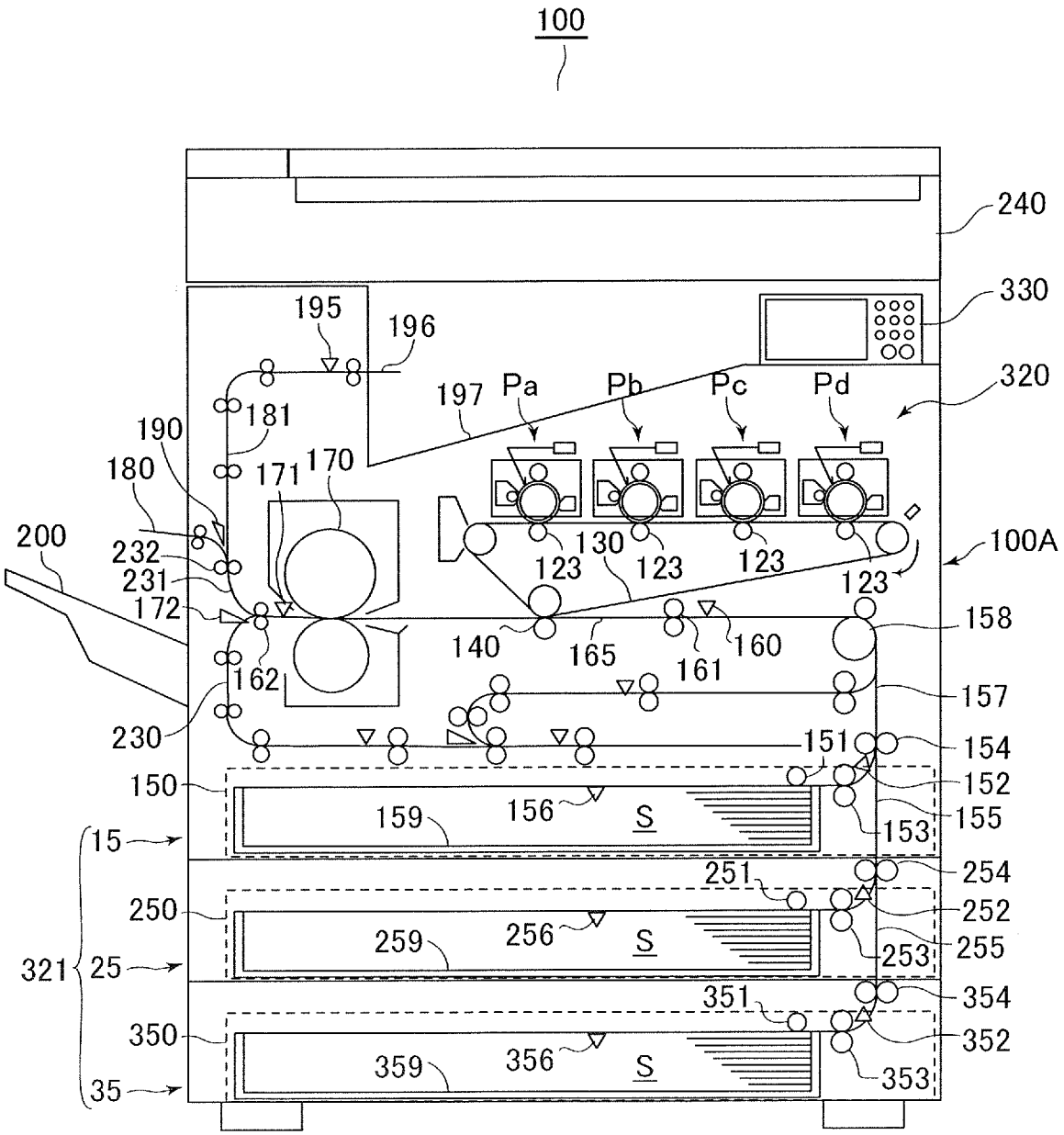
FIG. 1 is a diagram schematically illustrating an image forming apparatus of an embodiment of the present disclosure.

FIG. 1 is a diagram schematically illustrating an image forming apparatus 100 of the present embodiment. The image forming apparatus 100 forms an image on a sheet, used as a recording medium, in accordance with image information sent from an external device or read from a document. The sheet used as a record medium may be one of various sheet materials having different materials, shapes, and sizes. For example, the sheet may be a paper sheet such as a printing paper sheet or an envelope, a plastic film used for overhead projectors, or a cloth sheet.

Figure 2:
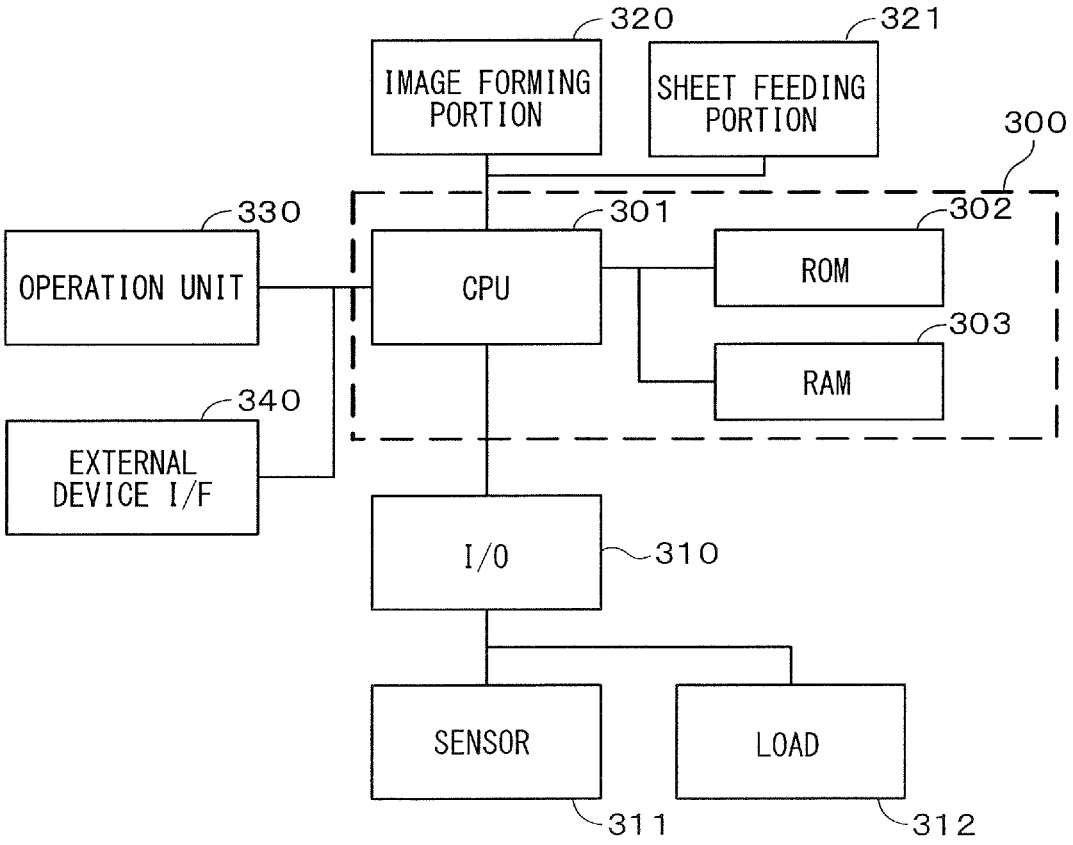
FIG. 2 is a block diagram illustrating a control system of the image forming apparatus of the present embodiment.

FIG. 2 is a block diagram illustrating a control system of the image forming apparatus 100. The image forming apparatus 100 includes a control unit 300, which is a controller of the present embodiment. The control unit 300 is a control circuit, which includes at least one processor and a nonvolatile storage medium that stores data processed by the processor. The control unit 300 of the present embodiment includes a central processing unit (CPU) 301, a read only memory (ROM) 302, and a random access memory (RAM) 303. The CPU 301 reads a program stored in the ROM 302, and executes the program for controlling the operation of the image forming apparatus 100. The operation of the image forming apparatus 100 includes operations that will be described with reference to later-described flowcharts. That is, the ROM 302 that stores the control program is an example of non-transitory computer-readable storage media used to control the image forming apparatus 100 by using a specific control method. The RAM 303 serves as a working area used by the CPU 301, which executes the program.

The control unit 300 is connected to an operation unit 330, which is a user interface of the image forming apparatus 100. In addition, the control unit 300 can be connected to an external computer via an external-device interface (I/F) 340 and a network. The operation unit 330 includes a display, hard keys, and a touch-panel function of the display. The display serves as a display unit and displays information in the form of images and characters for a user. The hard keys and the touch-panel function serve as an input unit, on which a user performs an input operation. Upon receiving an image forming instruction from the operation unit 330 or an external computer, the control unit 300 executes a series of operations (image forming jobs) for forming an image on a sheet, which is a recording medium, and for outputting the sheet.

The CPU 301 receives signals outputted from various sensors 311 of the image forming apparatus 100, via an input/output interface (I/O) 310; and actuates various loads 312 (including a motor), via the I/O 310. In addition, the CPU 301 causes an image forming portion 320 of the image forming apparatus 100 to perform an image forming operation, and causes a sheet feeding portion 321 of the image forming apparatus 100 to perform a sheet feeding operation. Specifically, the CPU 301 controls components of the image forming portion 320, such as motors, a high-voltage board, and a laser scanner. The motors are used to drive rotary members, such as a photosensitive drum and an intermediate transfer belt. The high-voltage board is used to apply bias voltages to a primary transfer roller and a secondary transfer roller. In addition, the CPU 301 controls components of the sheet feeding portion 321, such as motors used to drive rollers that feed and convey the sheet.

Image Forming Portion

As illustrated in FIG. 1, the image forming apparatus 100 includes an apparatus body 100A that houses the image forming portion 320, and an image reading apparatus 240 that is disposed above the apparatus body 100A for reading image information from a document. The image forming portion 320, which is one example of image forming portions, is an intermediate-transfer electrophotographic unit including four image-forming stations Pa, Pb, Pc, and Pd, an intermediate transfer belt 130, and a fixing unit 170. The image forming portion 320 forms an image on a sheet S that is conveyed along a main conveyance path 165 formed in the apparatus body 100A.

Figure 3:
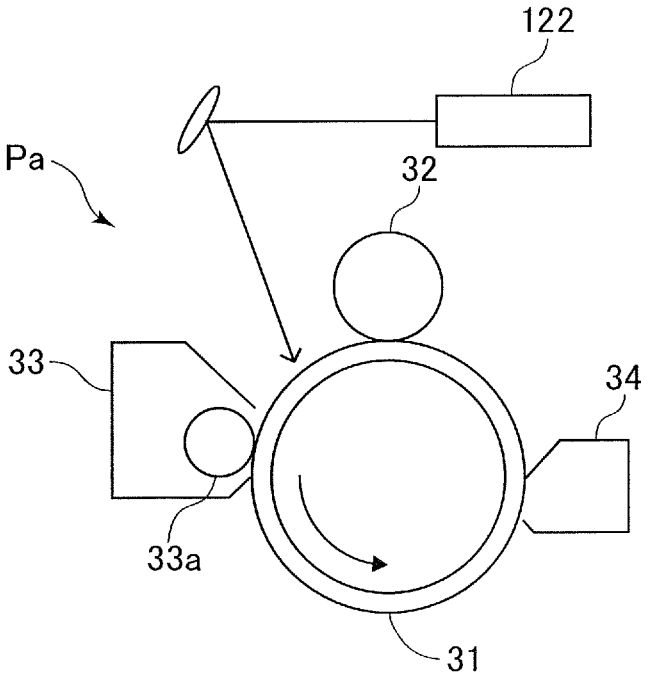
FIG. 3 is a diagram schematically illustrating an image forming station of the present embodiment.

As illustrated in FIG. 3 for a configuration of the image forming station Pa, each of the image forming stations Pa to Pd includes a photosensitive drum 31 that is a photosensitive member, a charging roller 32, a laser scanner 122, a developing apparatus 33, and a cleaning apparatus 34. Each of the image forming stations Pa to Pd forms a toner image on the surface of the photosensitive drum 31 by performing the electrophotographic process. Specifically, when an image forming operation is started, the photosensitive drum 31 is rotated, and the surface of the photosensitive drum 31 is uniformly charged by the charging roller 32. The laser scanner 122 generates a laser beam in accordance with image information and emits the laser beam to the surface of the photosensitive drum 31 for exposure and forms an electrostatic latent image on the photosensitive drum 31. The developing apparatus 33 includes a developing roller 33*a* that bears developer which contains toner and develops the electrostatic latent image into a toner image by supplying charged toner particles to the photosensitive drum 31.

Such operations of one of the image forming stations Pa to Pd are performed in parallel with the operations of the others, and a toner image having a corresponding color and borne by the photosensitive drum 31 is primary-transferred from the photosensitive drum 31 onto the intermediate transfer belt 130 by a primary transfer roller 123 illustrated in FIG. 1. Sticking substance, such as toner, left on the photosensitive drum 31 is removed by the cleaning apparatus 34 (FIG. 3) of each of the image forming stations Pa to Pd.

The intermediate transfer belt 130, which is an intermediate transfer member, is wound around a plurality of rollers including a secondary transfer inner roller, a tension roller, and a stretching roller; and is rotated clockwise in FIG. 1. The toner image borne by the intermediate transfer belt 130 is secondary-transferred onto the sheet S in a secondary transfer portion, which is formed between a secondary transfer roller 140 and the intermediate transfer belt 130. The secondary transfer roller 140 is disposed, facing the secondary transfer inner roller. Sticking substance, such as toner, left on the intermediate transfer belt 130 is removed by a belt cleaning apparatus.

The sheet S onto which the toner image has been transferred is delivered to the fixing unit 170. The fixing unit 170 includes a fixing roller pair and a heat source (such as a halogen lamp). The fixing roller pair conveys the sheet S while nipping the sheet S therebetween, and the heat source heats the toner image formed on the sheet S, via the fixing roller pair. While conveying the sheet S, the fixing unit 170 melts the toner by applying heat and pressure to the toner image. When the toner is solidified, the toner image is fixed to the sheet S.

The above-described image forming portion 320 is one example of image forming portions. Thus, the image forming portion 320 may be a direct-transfer electrophotographic unit, or may be an ink-jet or offset-printing image forming unit.

Sheet Feeding Portion

Next, a sheet feeding portion 321 of the image forming apparatus 100 will be described with reference to FIG. 1. The image forming apparatus 100 of the present embodiment includes the sheet feeding portion 321, which is disposed below the apparatus body 100A. The sheet feeding portion 321 includes a first sheet feeding portion 15, a second sheet feeding portion 25, and a third sheet feeding portion 35. The first sheet feeding portion 15 is a first feeding portion of the present embodiment, the second sheet feeding portion 25 is a second feeding portion of the present embodiment, and the third sheet feeding portion 35 is a third feeding portion of the present embodiment.

The first sheet feeding portion 15 includes a first feeding cassette 150, a feed roller 151 that feeds the sheet S from a cassette body 159 of the first feeding cassette 150, and a separation roller pair 153 that conveys the sheet S while separating the sheet S from other sheets. The first feeding cassette 150 can be inserted to and drawn from the apparatus body 100A of the image forming apparatus 100. The separation roller pair 153 includes a conveyance roller and a separation roller. The conveyance roller comes to contact an uppermost sheet fed from the first feeding cassette 150 by the feed roller 151 and applies conveyance force to the sheet, and the separation roller is disposed in contact with the conveyance roller. The separation roller, which is an example of separation members, applies frictional force to the sheets other than the uppermost sheet toward a direction opposite to a sheet conveyance direction. In this manner, the separation roller prevents the sheets other than the uppermost sheet from passing through a nip portion of the separation roller pair.

In addition, the first sheet feeding portion 15 includes a first remaining-amount sensor 156, a first feed sensor 152, and a conveyance roller pair 154. The first remaining-amount sensor 156 is a first detection portion of the present embodiment and detects the amount of remaining sheets of the first feeding cassette 150. The first feed sensor 152 detects a sheet at a position downstream of the separation roller pair 153 in the sheet conveyance direction and is used for monitoring whether the sheet S is being conveyed from the first feeding cassette 150 as scheduled. The conveyance roller pair 154 receives the sheet S from the separation roller pair 153, and conveys the sheet S toward the image forming portion 320.

The second sheet feeding portion 25 is disposed below the first sheet feeding portion 15, and the third sheet feeding portion 35 is disposed below the second sheet feeding portion 25. The second sheet feeding portion 25 and the third sheet feeding portion 35 have substantially the same configuration as that of the first sheet feeding portion 15. That is, the second sheet feeding portion 25 includes a second feeding cassette 250 having a cassette body 259, a feed roller 251, a separation roller pair 253, a second remaining-amount sensor 256, a second feed sensor 252, and a conveyance roller pair 254. Similarly, the third sheet feeding portion 35 includes a third feeding cassette 350 having a cassette body 359, a feed roller 351, a separation roller pair 353, a third remaining-amount sensor 356, a third feed sensor 352, and a conveyance roller pair 354. The second remaining-amount sensor 256 is a second detection portion of the present embodiment, and the third remaining-amount sensor 356 is a third detection portion of the present embodiment.

The first feeding cassette 150 is provided with an intermediate path 155 to receive the sheet S fed from a lower cassette and convey the sheet S. Similarly, the second feeding cassette 250 is provided with an intermediate path 255 to receive the sheet S fed from a lower cassette and convey the sheet S. Specifically, the intermediate path 255 of the second feeding cassette 250 receives the sheet S fed from the third feeding cassette 350 and conveys the sheet S to the intermediate path 155 of the first feeding cassette 150. The intermediate path 155 of the first feeding cassette 150 receives the sheet S fed from the second feeding cassette 250 or the third feeding cassette 350 and conveys the sheet S to the sheet conveyance path 157 of the apparatus body 100A.

The first feeding cassette 150 is a first cassette of the present embodiment, the second feeding cassette 250 is a second cassette of the present embodiment, and the third feeding cassette 350 is a third cassette of the present embodiment. The intermediate path 155 of the first feeding cassette 150 is a first conveyance path of the present embodiment, and the intermediate path 255 of the second feeding cassette 250 is a second path of the present embodiment. Note that although the third feeding cassette 350 has no intermediate path in FIG. 1, the third feeding cassette 350 may also be provided with an intermediate path, which is joined with another sheet feeding portion disposed below the third sheet feeding portion 35.

In the present embodiment, the feeding cassettes 150, 250, and 350 of the sheet feeding portions 15 to 35 are housed in one frame so as to be drawable from the one frame, and the image forming portion 320 of the image forming apparatus 100 is housed in another frame. The one frame and the other frame form the apparatus body 100A of the image forming apparatus 100. That is, the apparatus body 100A is not only an apparatus body of the image forming apparatus but also an apparatus body of the sheet feeding apparatus of the present embodiment.

Sheet Conveyance Operation

Next, a sheet conveyance operation performed when the image forming apparatus 100 performs an image forming job will be described with reference to FIG. 1. When a user inputs a start command (print command) into the operation unit 330 for forming an image on a sheet, or when instruction data containing an image is sent to the image forming apparatus 100 via a network, an image forming job is given to the image forming apparatus 100. The data for the image forming job contains not only the data on an image to be printed, but also the setting data on job setting information. The job setting information includes setting for the size and the type of the sheet (classified in accordance with material, grammage, and the like), the number of copies, the number of pages per copy, duplex printing, a destination to which sheets are discharged, and the like.

When an image forming job is given, any one of the sheet feeding portions 15, 25, and 35 starts to perform a sheet feeding operation. When the first sheet feeding portion 15 feeds a sheet, a motor that is a driving source for the feed roller 151 and the separation roller pair 153 is rotated, and the uppermost sheet of the sheets S stored in the first feeding cassette 150 is fed one by one.

In parallel with this operation, whether the sheet S is normally being conveyed is monitored by using the first feed sensor 152. For example, the first feed sensor 152 changes its detection signal when the leading edge of a sheet (i.e., downstream edge of the sheet in the sheet conveyance direction) that is being fed passes a detection position of the first feed sensor 152, and when the trailing edge of the sheet (i.e., upstream edge of the sheet in the sheet conveyance direction) passes the detection position. The control unit 300 compares a timing at which the detection signal changes when the feeding operation is performed as scheduled, with a timing at which the detection signal by the first feed sensor 152 has actually changed, and thereby determines whether the sheet S is being normally fed. For example, if the first feed sensor 152 has not detected the leading edge of the sheet when a predetermined time has elapsed since the start of driving of the feed roller 151, the control unit 300 determines that the sheet S has not been normally fed for some reason.

The sheet S fed from the first feeding cassette 150 is conveyed to the sheet conveyance path 157 of the apparatus body 100A by the conveyance roller pair 154. When the sheet S is fed from the first feeding cassette 150, the amount of remaining sheets of the first feeding cassette 150 is detected by the first remaining-amount sensor 156. The method to detect the amount of remaining sheets will be described in the later-described "remaining-amount determination process".

When the sheet S is fed from the second sheet feeding portion 25 or the third sheet feeding portion 35, the sheet S is fed in substantially the same manner as that by the first sheet feeding portion 15. The amount of remaining sheets of the second feeding cassette 250 is detected by using the second remaining-amount sensor 256, and the amount of remaining sheets of the third feeding cassette 350 is detected by using the third remaining-amount sensor 356. In addition, whether the sheet S is normally fed from the second feeding cassette 250 is monitored by using the second feed sensor 252, and whether the sheet S is normally fed from the third feeding cassette 350 is monitored by using the third feed sensor 352.

The sheet S fed from the second feeding cassette 250 is conveyed to the intermediate path 155 of the first feeding cassette 150 by the conveyance roller pair 254, and then conveyed to the sheet conveyance path 157 of the apparatus body 100A by the conveyance roller pair 154. In addition, the sheet S fed from the third feeding cassette 350 is conveyed to the intermediate path 255 of the second feeding cassette 250 by the conveyance roller pair 354, and then conveyed to the sheet conveyance path 157 of the apparatus body 100A by the conveyance roller pairs 254 and 154.

As described above, in the present embodiment, the sheet fed from the lower cassette (e.g., cassette 350) passes through the intermediate paths 255 and 155 of the upper cassettes (e.g., cassettes 250 and 150). Thus, for example, if a user draws the first feeding cassette 150 from the apparatus body 100A for supplying sheets when the sheet S is being fed from the second feeding cassette 250, the conveyance path for the sheet S will be cut off, possibly causing sheet jam. A configuration to avoid such a problem will be described later.

The sheet S fed from the sheet feeding portion 321 is conveyed to a registration roller pair 161 of the main conveyance path 165, via a conveyance roller 158. The control unit 300 monitors, by using a pre-registration-process sensor 160, the timing at which the sheet S reaches the registration roller pair 161. In addition, the control unit 300 controls the conveyance of the sheet S depending on a detection signal from the pre-registration-process sensor 160 so that the leading edge of the sheet S and the leading edge of the toner image borne by the intermediate transfer belt 130 reach the secondary transfer portion at the same time. For example, when the sheet S reaches the registration roller pair 161 too early with respect to a current position of the toner image, the registration roller pair 161 temporarily stops the sheet S and then conveys the sheet S. When the sheet S passes though the secondary transfer portion, the toner image is transferred onto the sheet S. After that, when the sheet S passes through the fixing unit 170, the toner image is fixed to the sheet S.

When the leading edge of the sheet S having passed through the fixing unit 170 reaches a post-fixing-process sensor 171, the control unit 300 determines a conveyance path of the sheet S depending on the setting information of the image forming job and switches a flap-like guide member 172 in accordance with the determination result. Specifically, if an image has been formed on a first surface of a sheet in duplex printing, the sheet is guided to a duplex conveyance path 230; if an image has been formed on a sheet in single-side printing or on a second side of a sheet in duplex printing, the sheet is guided to a discharging conveyance path 231.

The sheet S conveyed to the discharging conveyance path 231 is further conveyed by a discharging roller 232 and guided to an outer discharging path 180 or an upper discharging path 181 by a flap-like guide member 190 that is switched in accordance with the setting information of the image forming job. If the destination to which the sheet S is to be discharged is an outer discharging tray 200, the sheet S is guided to the outer discharging path 180 and discharged onto the outer discharging tray 200. If the destination to which the sheet S is to be discharged is an upper discharging tray 197, the sheet S is guided to the upper discharging path 181 and discharged onto the upper discharging tray 197.

Control Method of Displaying the Amount of Remaining Sheets

Next, a method of displaying the amount of remaining sheets of the feeding cassette 150, 250, or 350 on the operation unit 330 and a control method thereof will be described. Each process of the below-described flowcharts is achieved by the CPU 301 (illustrated in FIG. 2) executing a control program, unless otherwise specified. It is noted that part or all of the processes may be achieved by a processor other than the CPU 301 or an ASIC.

Figure 4:
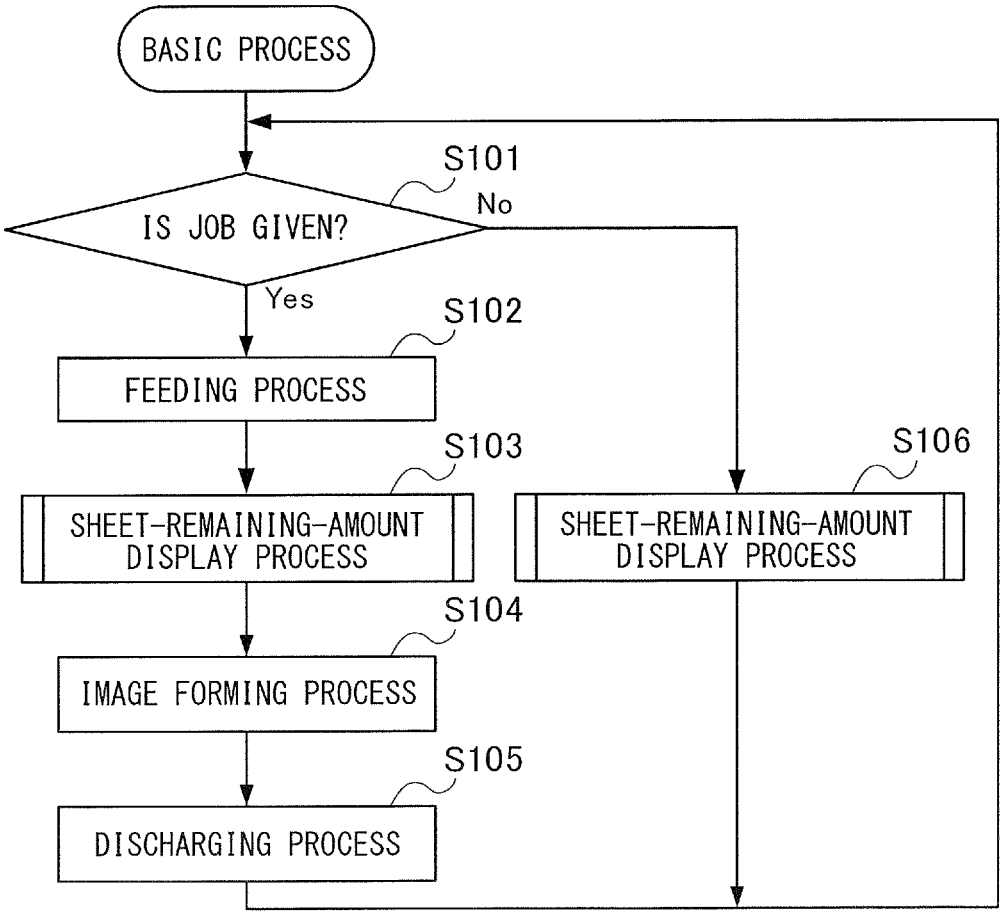
FIG. 4 is a flowchart illustrating a basic process of the present embodiment.

FIG. 4 is a flowchart illustrating a basic process of the image forming apparatus 100. The process is continuously performed while the power source for the image forming apparatus 100 is ON. First, the control unit 300 determines whether there is an image forming job (S101). If there is an image forming job that is still not processed or being processed, the control unit 300 starts to perform a feeding process (S102), a sheet-remaining-amount display process (S103), an image forming process (S104), and a discharging process (S105) in a sequential manner. The feeding process, the sheet-remaining-amount display process, the image forming process, and the discharging process for an identical image forming job are respectively started in steps S102 to S105, and then performed in parallel with each other. If there is no image forming job, then the control unit 300 performs a sheet-remaining-amount display process (S106). After performing the step S105 or S106, the control unit 300 returns to the step S101 and repeats the same processes.

Figure 5:
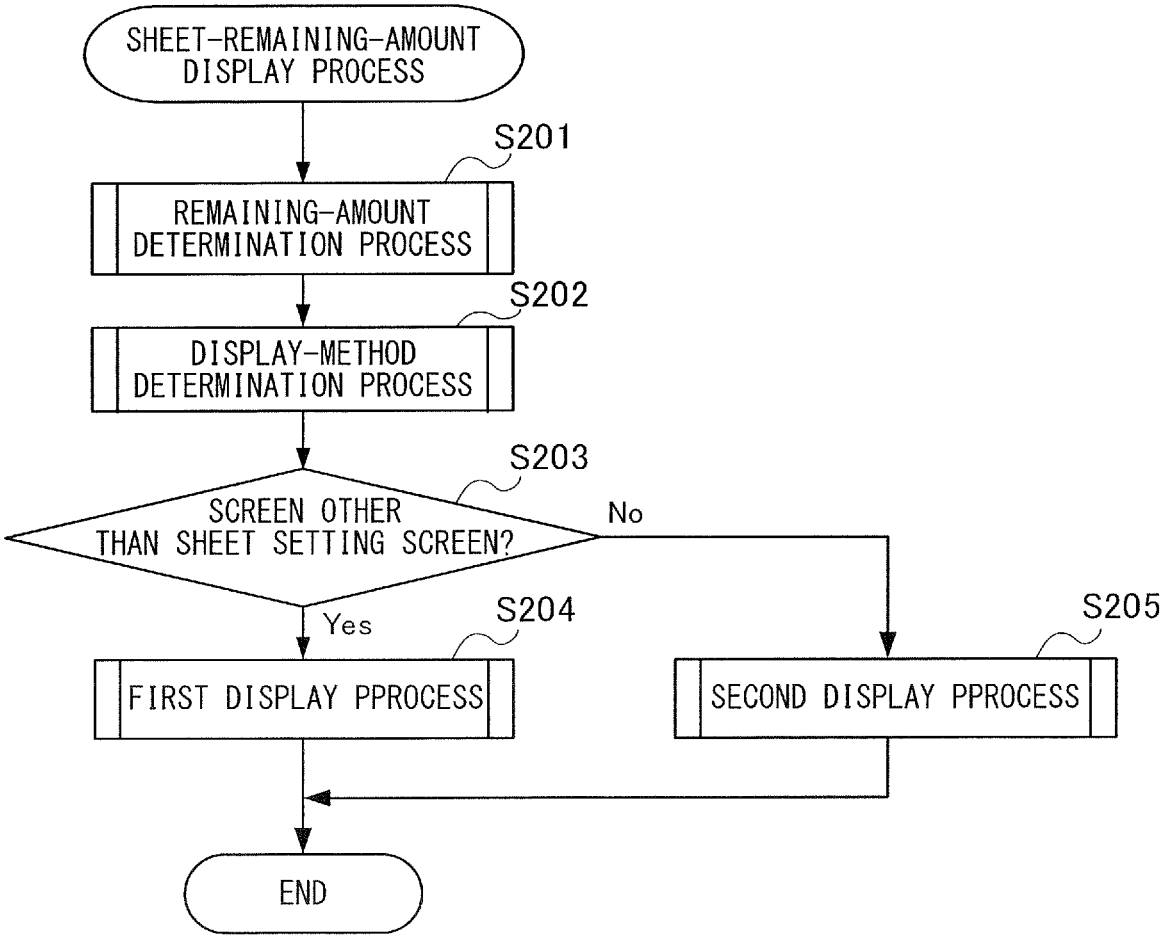
FIG. 5 is a flowchart illustrating a sheet-remaining-amount display process of the present embodiment.

FIG. 5 is a flowchart illustrating the sheet-remaining-amount display process. The sheet-remaining-amount display process is a process to display information on the amount of remaining sheets of the feeding cassette 150, 250, or 350, on the operation unit 330. As described below, the control unit 300 controls display of the operation unit 330 in accordance with the amount of remaining sheets of each cassette and a current state of the image forming apparatus 100.

In the sheet-remaining-amount display process, the control unit 300 first performs a remaining-amount determination process (S201) for obtaining the amount of remaining sheets of each cassette of the image forming apparatus 100. Then the control unit 300 performs a display-method determination process (S202) for determining an appropriate display method for each cassette. After that, the control unit 300 performs a first display process (S204) if a current display screen is a screen other than a sheet setting screen that displays setting information of the feeding cassettes (S203: Yes), or performs a second display process (S205) if the current screen is the sheet setting screen (S203: No).

The detailed description of the remaining-amount determination process, the display-method determination process, the first display process, and the second display process will be made later. In the following description, the first feeding cassette 150 that is an uppermost cassette is referred to as a first cassette, the second feeding cassette 250 that is disposed lower than the first feeding cassette 150 is referred to as a second cassette, and the third feeding cassette 350 that is disposed lower than the second feeding cassette 250 is referred to as a third cassette. Thus, in the present embodiment, each of variables K, L, M, and N, which are used in the below-described processes and represent the number of each cassette, is any one of 1, 2, and 3.

Remaining-Amount Determination Process

Figure 6:
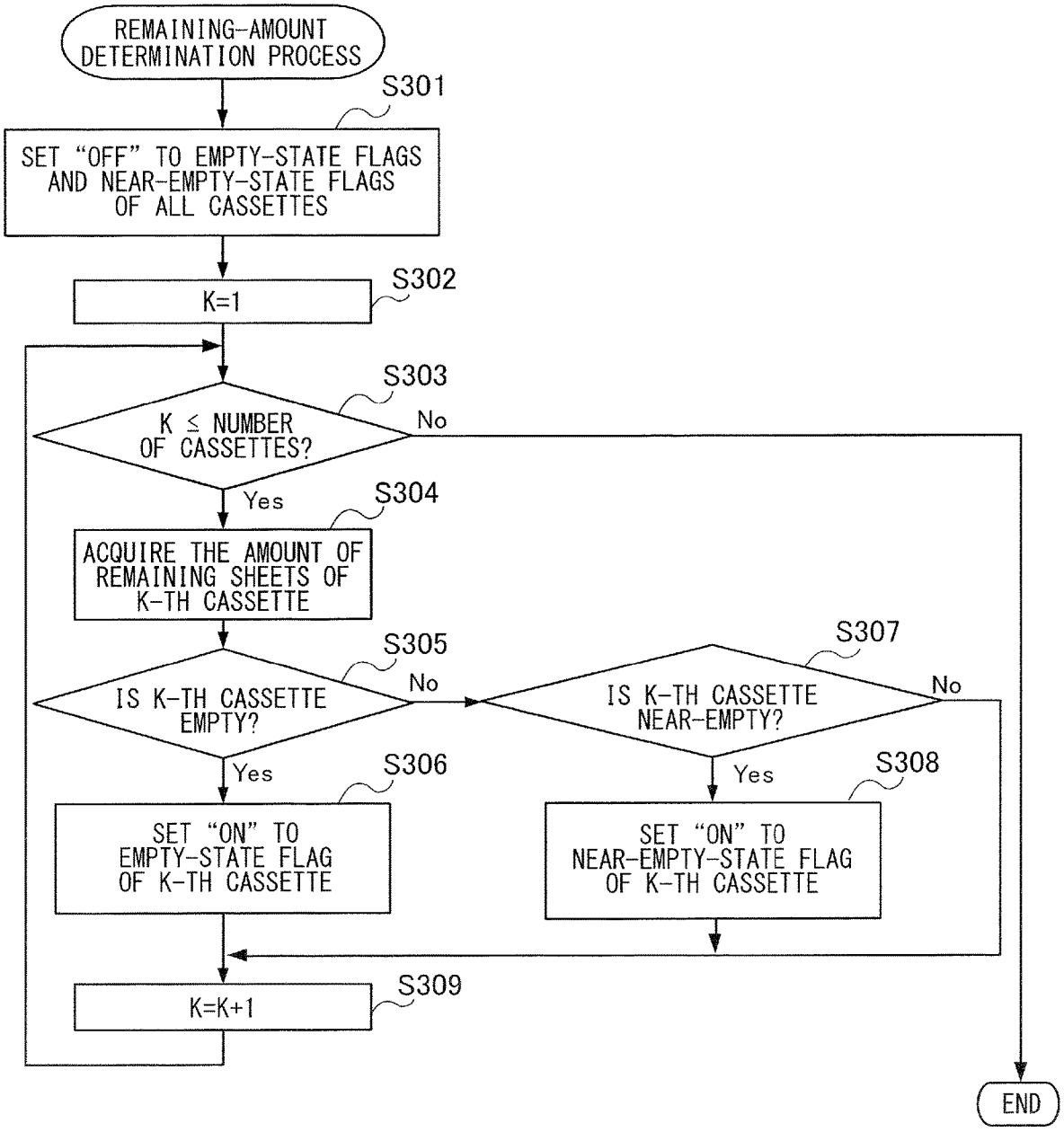
FIG. 6 is a flowchart illustrating a remaining-amount determination process of the present embodiment.

Next, the remaining-amount determination process (S201 in FIG. 5) of the sheet-remaining-amount display process will be described with reference to FIG. 6. In the remaining-amount determination process, the control unit 300 determines the amount of remaining sheets of each cassette by using the remaining-amount sensors 156, 256, and 356 respectively disposed in the feeding cassettes 150, 250, and 350. In the present embodiment, the control unit 300 determines the amount of remaining sheets of each cassette, as one of three states: a state in which the amount of remaining sheets is sufficient, a state in which the amount of remaining sheets is near-empty, and a state in which the cassette is empty.

When the control unit 300 starts the remaining-amount determination process, the control unit 300 first resets empty-state flags and near-empty-state flags of all cassettes (S301), and sets 1 to the variable K that indicates the number of a feeding cassette (S302). Each of the empty-state flags is a variable indicating that when the empty-state flag is ON, the cassette corresponding to the empty-state flag is empty. In addition, each of the near-empty-state flags is a variable indicating that when the near-empty-state flag is ON, the amount of remaining sheets of the cassette corresponding to the near-empty-state flag is near-empty. When both the empty-state flag and the near-empty-state flag are OFF, they indicate that the amount of remaining sheets of the cassette corresponding to the empty-state flag and the near-empty-state flag is sufficient.

The control unit 300 then performs steps S303 to S309 on a K-th cassette. First, the control unit 300 compares the value of K with the number of the cassettes of the image forming apparatus 100 (i.e., the number of the feeding cassettes recognized by the control unit 300) (S303). If the value of K is equal to or smaller than the number of the cassettes, then the control unit 300 obtains the amount of remaining sheets of the K-th cassette, which is detected by the remaining-amount sensor, 156, 256, or 356, disposed in the K-th cassette (S304).

For example, the amount of remaining sheets is detected as below by the remaining-amount sensor 156. The first remaining-amount sensor 156 is disposed in the cassette body 159 of the first feeding cassette 150 and detects the top surface of the sheet S at a predetermined position positioned above a supporting plate (e.g., position at which the feed roller 151 abuts against the sheet) (see FIG. 1). The supporting plate moves up and down while supporting the sheet S. When starting the feeding operation, the CPU 301 obtains the amount of movement of the supporting plate performed from when the supporting plate starts to move up until when the first remaining-amount sensor 156 detects the top surface of the sheet S. Here, the amount of movement is equivalent to the amount of rotation of a motor that drives the supporting plate. Then, the CPU 301 calculates a height between the predetermined position and a position of the supporting plate obtained when the first remaining-amount sensor 156 detects the sheet, and thereby obtains the amount of remaining sheets of the first feeding cassette 150. When sheets are fed and the height of the top surface of the other sheets decreases, the first remaining-amount sensor 156 is turned OFF (a state of not detecting the top surface of the remaining sheets). In this case, the CPU 301 moves up the supporting plate again until the first remaining-amount sensor 156 detects the top surface of the remaining sheets. Then the CPU 301 obtains the amount of additional movement of the supporting plate and recalculates the amount of remaining sheets of the first feeding cassette 150.

The CPU 301 stores the calculated amount of remaining sheets of the first feeding cassette 150 in a nonvolatile storage device (e.g., EEPROM) of the control unit 300. Note that, in the step S304, the CPU 301 can obtain the amount of remaining sheets by accessing the storage device of the control unit 300 and referring to a storage area in which the data on the amount of remaining sheets is stored. It is noted that the method of obtaining the amount of remaining sheets is not limited to this. For example, the amount of remaining sheets may be obtained by using a sensor (so-called fully-stacked-sheets sensor) that detects a predetermined amount of sheets stored in a cassette. In this case, the amount of remaining sheets is calculated by counting the cumulative number of sheets fed from when the predetermined amount of sheets was stored.

If the control unit 300 determines that the K-th cassette is empty, by checking the amount of remaining sheets of the K-th cassette obtained in S304 (S305: Yes), then the control unit 300 sets an ON value to the empty-state flag of the K-th cassette (S306). If the control unit 300 determines that the amount of remaining sheets of the K-th cassette is near-empty (S305: No and S307: Yes), then the control unit 300 sets an ON value to the near-empty-state flag of the K-th cassette (S308). If the control unit 300 determines that the K-th cassette is not empty, and that the amount of remaining sheets of the K-th cassette is not near-empty, then the control unit 300 leaves the empty-state flag OFF and the near-empty-state flag OFF.

The state in which a cassette is empty may be a state in which the amount of remaining sheets of the cassette is 0% of the maximum amount 100% of sheets that can be stored in the cassette. In addition, the state in which the amount of remaining sheets of a cassette is near-empty may be a state in which the amount of remaining sheets of the cassette is 0 to 20% of the maximum amount 100% of sheets that can be stored in the cassette. The criteria for the determination, however, are not limited to those. For example, the state in which a cassette is empty may be determined when a slight amount of sheets is stored in the cassette and the amount of sheets is less than a predetermined threshold.

Then, the control unit 300 increments the value of K by 1 (S309), and returns to the step S303 for performing the process for the next cassette. When the control unit 300 reaches the step S303 after completing the processes for all cassettes, the value of K is larger than the number of all cassettes (S303: No). Thus, the control unit 300 ends the remaining-amount determination process.

Display-Method Determination Process

Figure 7:
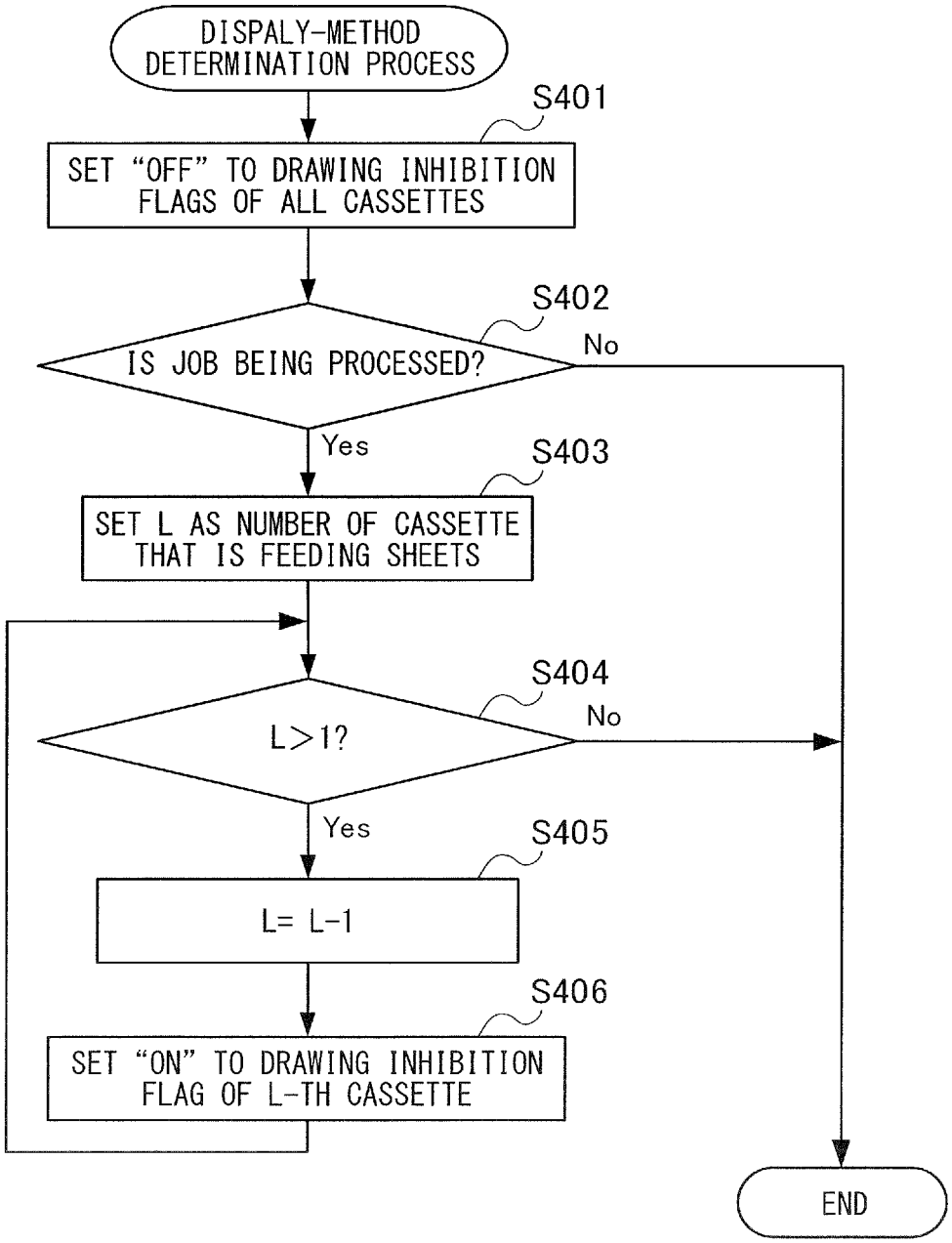
FIG. 7 is a flowchart illustrating a display-method determination process of the present embodiment.

Next, the display-method determination process (S202 in FIG. 5) of the sheet-remaining-amount display process will be described with reference to FIG. 7. The display-method determination process is a process to change a method of displaying the amount of remaining sheets of each cassette on the operation unit 330. Specifically, in the display-method determination process, the control unit 300 changes the display method in accordance with a current state of the image forming apparatus 100. In the present embodiment, the control unit 300 changes the display method depending on whether an image forming job is being performed.

In the display-method determination process, the control unit 300 first resets drawing inhibition flags of all cassettes and sets an initial OFF value to the drawing inhibition flags (S401). Each of the drawing inhibition flags is a variable indicating that when the drawing inhibition flag is ON, a feeding cassette corresponding to the drawing inhibition flag is inhibited from being drawn out (pulled out) from the apparatus body. Then, the control unit 300 determines whether an image forming job is being performed (S402). If no image forming job is being performed, then the control unit 300 determines that any one of the feeding cassettes 150, 250, and 350 can be drawn without trouble, and ends the display-method determination process. If an image forming job is being performed, then the control unit 300 determines in steps S403 to S406 whether to inhibit drawing of each cassette.

The control unit 300 sets the value of the variable L, which indicates the number of a feeding cassette, as the number of a cassette used as a sheet feeding source (i.e., cassette that is feeding sheets) in the image forming job (S403). If the value of L is 1 (S404: No), then the control unit 300 ends the display-method determination process because there is no cassette above the cassette that is feeding sheets.

When the value of L is larger than 1 in S404 (S404: Yes), there is at least one cassette above the cassette that is feeding sheets. Thus, the control unit 300 sets an ON value to the drawing inhibition flag of the upper cassette. That is, the control unit 300 subtracts 1 from the value of L (S405) and sets an ON value to the drawing inhibition flag of the L-th cassette (S406) until the value of L becomes 1. With this operation, when an image forming job is being performed using sheets from the second feeding cassette 250 for example, the drawing inhibition flag of the first feeding cassette 150 is set to ON and the drawing inhibition flag of the third feeding cassette 350 is set to OFF.

First Display Process

Figure 8:
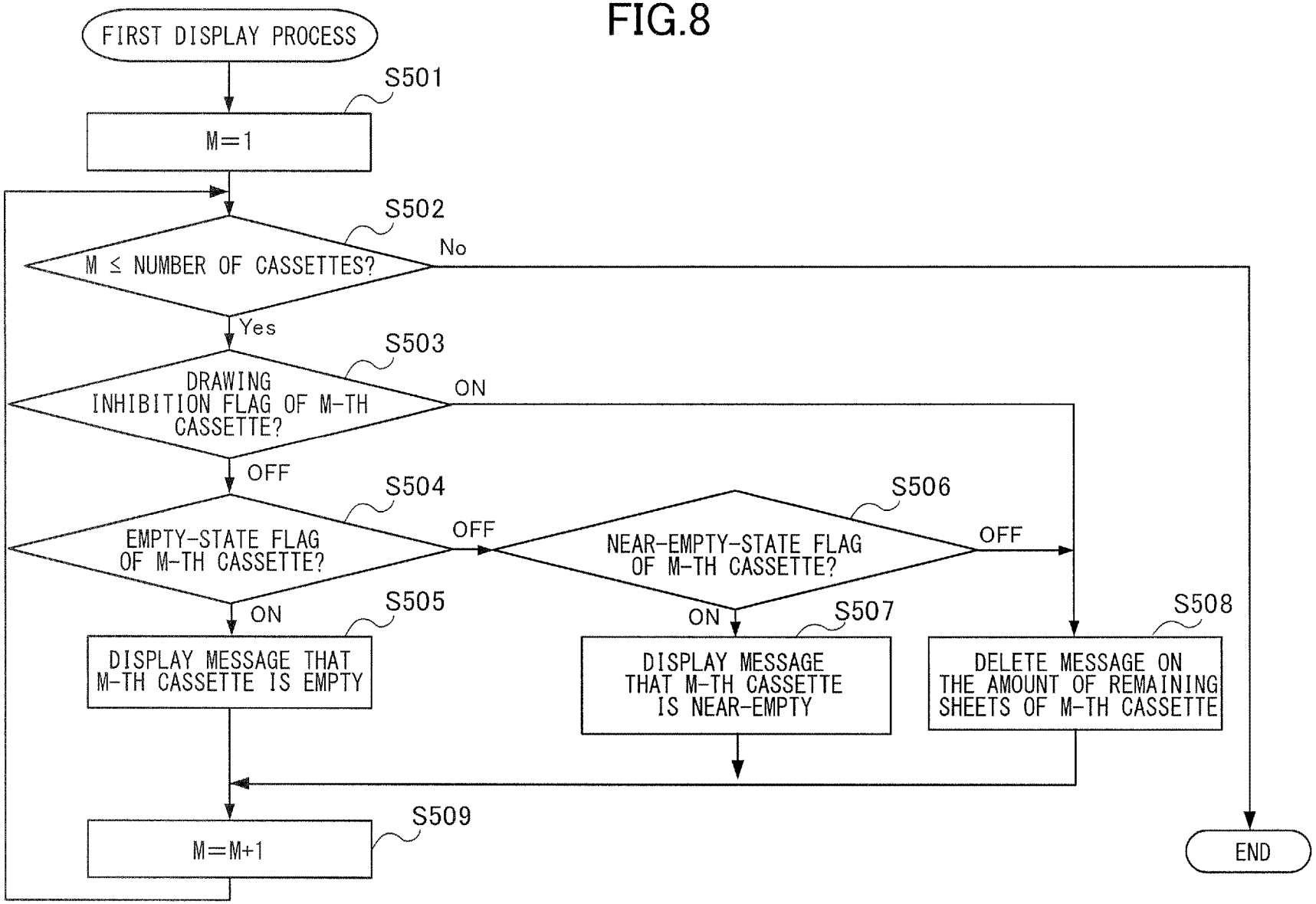
FIG. 8 is a flowchart illustrating a first display process of the present embodiment.

Next, the first display process (S204 in FIG. 5) of the sheet-remaining-amount display process will be described with reference to FIG. 8. The first display process is a process to display the information on the amount of remaining sheets of a feeding cassette on a screen of the operation unit 330 that is not directly related to the setting of the feeding cassettes (for example, the screen can be a home screen used for selecting a main function of the image forming apparatus 100).

When the control unit 300 starts the first display process, the control unit 300 sets 1 to the variable M, which indicates the number of a feeding cassette (S501). Then, the control unit 300 performs steps S503 to S508 for the M-th cassette until the value of M exceeds the number of the cassettes of the image forming apparatus 100 (S502: Yes). First, the process branches depending on the value of the drawing inhibition flag of the M-th cassette (S503). If the drawing inhibition flag of the M-th cassette is ON, then control unit 300 deletes the message on the amount of remaining sheets of the M-th cassette, displayed on the operation unit 330 (S508).

If the drawing inhibition flag of the M-th cassette is OFF and the empty-state flag of the M-th cassette is ON (S504: ON), then the control unit 300 instructs the operation unit 330 to display a message that the M-th cassette is empty (S505). If the empty-state flag of the M-th cassette is OFF and the near-empty-state flag of the M-th cassette is ON (S506: ON), then the control unit 300 instructs the operation unit 330 to display a message that the amount of remaining sheets of the M-th cassette is near-empty (S507). If both the empty-state flag and the near-empty-state flag of the M-th cassette are OFF, then the control unit 300 instructs the operation unit 330 to delete the message on the amount of remaining sheets of the M-th cassette (S508).

Then the control unit 300 increments the value of M by 1 for determining whether to display a message on the amount of remaining sheets of the next cassette (S509). The control unit 300 then returns to the step S502, compares the value of M with the number of the cassettes of the image forming apparatus 100, and performs the same operations (S503 to S509) for the next cassette if the value of M is equal to or smaller than the number of the cassettes. With this operation, a message on the amount of remaining sheets is displayed for each cassette, among the cassettes of the image forming apparatus 100, that is determined to display the message on the screen that is not directly related to the setting of the feeding cassettes.

Figure 10:
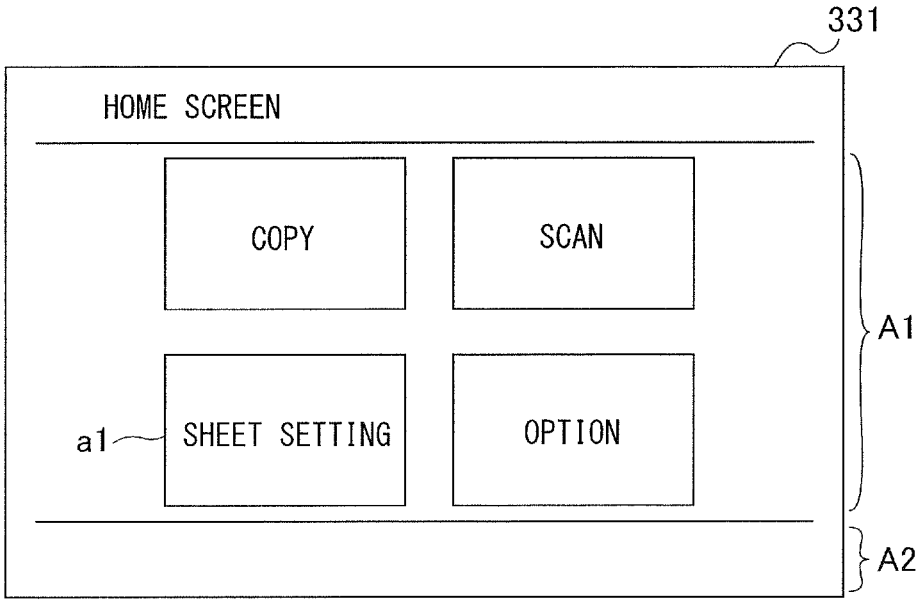
FIG. 10 is a diagram illustrating an example of a home screen of the present embodiment.
Figure 11:
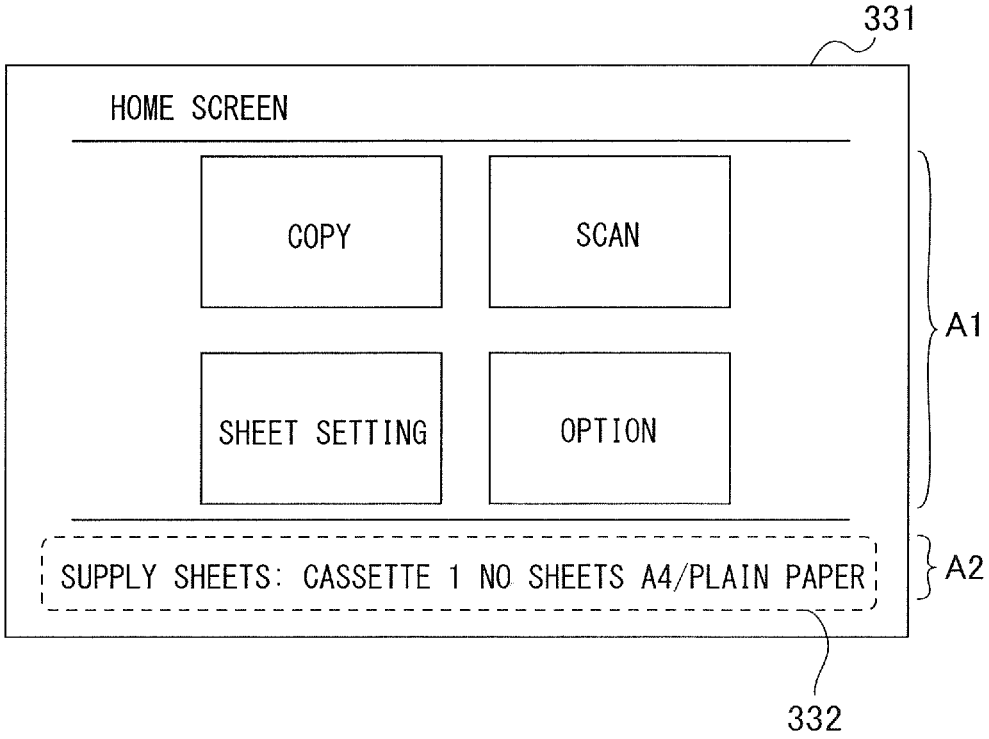
FIG. 11 is a diagram illustrating another example of the home screen of the present embodiment.

For example, in the first display process, the message on the amount of remaining sheets is displayed on a home screen 331 of the operation unit 330, as illustrated in FIG. 10. The home screen 331 is an example of a first screen. In the present embodiment, as illustrated in FIG. 11, a message section A2 is arranged below a button group A1, which is used to select a function of the image forming apparatus 100; and the message on the amount of remaining sheets is displayed in the message section A2. Specifically, a message 332 for a cassette (for which the message that the cassette is empty (S505) or the message that the amount of remaining sheets of the cassette is near-empty (S507) is displayed) is displayed, containing information on the number of the cassette and a current state (e.g., no sheets) of the cassette. Thus, the message on the amount of remaining sheets notifies a user that there is a cassette whose remaining sheets are near-empty (or there is a cassette which is empty), even on the screen other than a later-described sheet setting screen. Thus, the user can supply sheets as appropriate.

As the first feeding cassette 150 serves as a first cassette, the message 332 on the first feeding cassette 150 is first information on the amount of remaining sheets of the first cassette in the present embodiment. Similarly, as the second feeding cassette 250 serves as a second cassette, the message 332 on the second feeding cassette 250 is second information on the amount of remaining sheets of the second cassette in the present embodiment. The first and the second information of the present embodiment indicates that the amount of remaining sheets of a corresponding cassette is less than a predetermined reference value or is zero.

In the present embodiment, when the drawing inhibition flag of a cassette is ON, the message on the remaining amount of the cassette displayed on the operation unit 330 is deleted (S503: ON and S508), regardless of values of the empty-state flag and the near-empty-state flag of the cassette, which are determination results on the amount of remaining sheets of the cassette. Thus, when an image forming job is being performed using sheets from the second feeding cassette 250 for example, the message on the amount of remaining sheets of the first feeding cassette 150 is not displayed on the home screen 331 even if the amount of remaining sheets of the first feeding cassette 150 is near-empty. Similarly, when an image forming job is being performed using sheets from the third feeding cassette 350, the message on the amount of remaining sheets of the first feeding cassette 150 or the second feeding cassette 250 is not displayed on the home screen 331 even if the amount of remaining sheets of the first feeding cassette 150 or the second feeding cassette 250 is near-empty. Since a user does not receive a notification that the amount of remaining sheets of an upper cassette, which is located above a cassette that is feeding sheets, is near-empty, the possibility that the user opens the upper cassette carelessly (i.e., without realizing a fear of sheet jam) and causes sheet jam can be reduced.

On the other hand, when an image forming job is being performed using sheets from the first feeding cassette 150 for example, the message on the amount of remaining sheets of the second feeding cassette 250 is displayed. That is, when the message (second information) on the amount of remaining sheets of the second feeding cassette 250 is required to be displayed on the operation unit 330, the message on the amount of remaining sheets of the second feeding cassette 250 will be displayed, regardless of whether the first sheet feeding portion 15 is feeding sheets. In other words, the present embodiment is configured such that, in a case where the first feeding portion starts a sheet feeding operation in a state where the display unit is displaying the second information, the controller operates the display unit to keep displaying the second information. Thus, a user can draw a lower cassette, disposed below a cassette that is feeding sheets, depending on the message on the amount of remaining sheets of the lower cassette, and supply sheets.

In the present embodiment, the message on the amount of remaining sheets of a cassette that is feeding sheets is not deleted. However, the message on the amount of remaining sheets of the cassette that is feeding sheets may be deleted. In this case, in the display-method determination process illustrated in FIG. 7, a process to set an ON value to the drawing inhibition flag of the L-th cassette (i.e., cassette that is feeding sheets) may be performed immediately after the step S403.

Second Display Process

Figure 9:
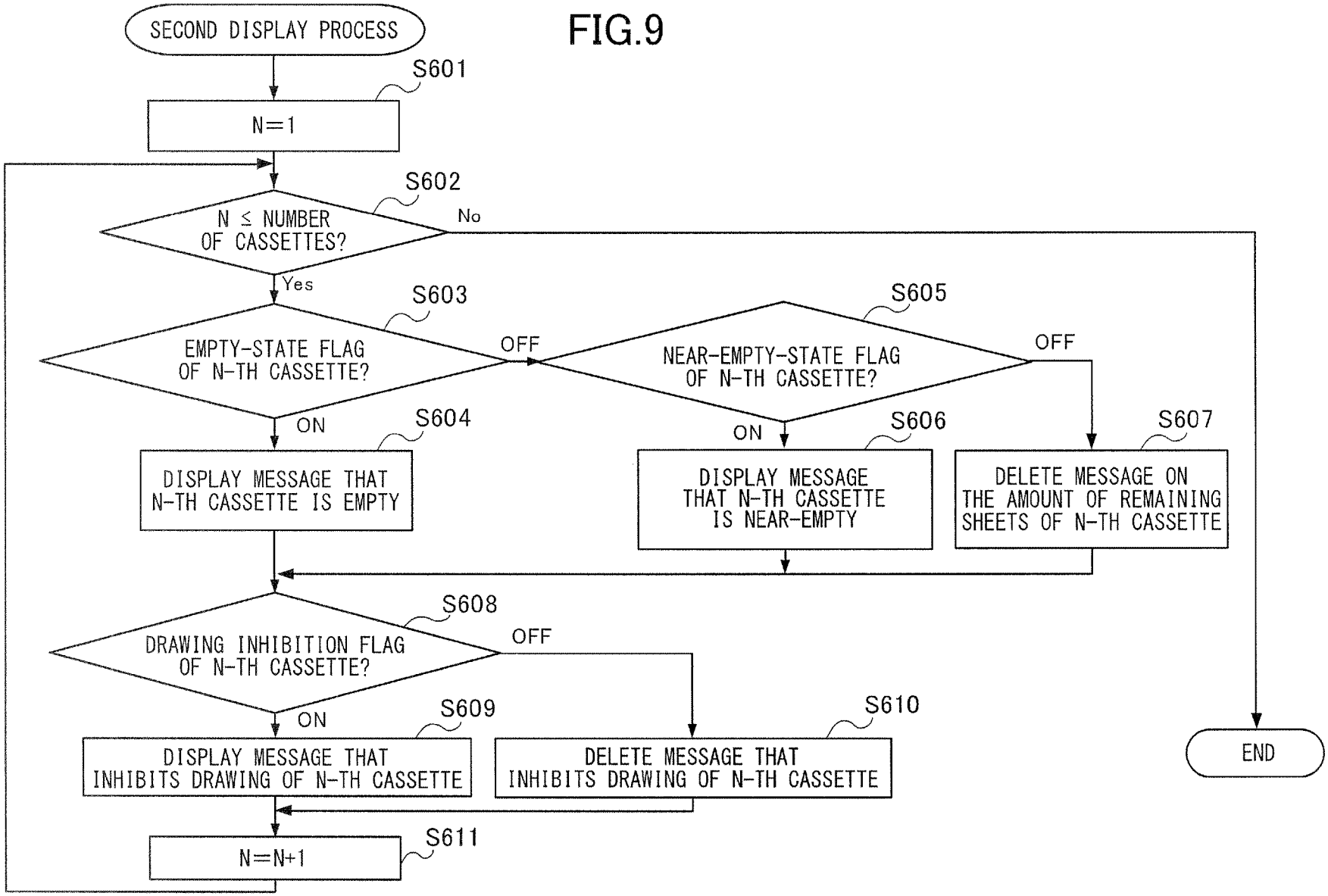
FIG. 9 is a flowchart illustrating a second display process of the present embodiment.

Next, the second display process (S205 in FIG. 5) of the sheet-remaining-amount display process will be described with reference to FIG. 9. The second display process is a process to display a message that inhibits drawing of a feeding cassette, on a screen (second screen) of the operation unit 330, used for performing the setting of the feeding cassettes.

When the control unit 300 starts the second display process, the control unit 300 sets 1 to the variable N, which indicates the number of a feeding cassette (S601). Then, the control unit 300 performs steps S603 to S611 for the N-th cassette until the value of N exceeds the number of the cassettes of the image forming apparatus 100 (S602: Yes). If the empty-state flag of the N-th cassette is ON (S603: ON), then the control unit 300 instructs the operation unit 330 to display a message that the N-th cassette is empty (S604). If the empty-state flag of the N-th cassette is OFF and the near-empty-state flag of the N-th cassette is ON (S605: ON), then the control unit 300 instructs the operation unit 330 to display a message that the amount of remaining sheets of the N-th cassette is near-empty (S606). If both the empty-state flag and the near-empty-state flag of the N-th cassette are OFF, then the control unit 300 instructs the operation unit 330 to delete the message on the amount of remaining sheets of the N-th cassette (S607).

After the operation unit 330 displays the message on the amount of remaining sheets of the N-th cassette in steps S604, S606, or S607, the process branches depending on the value of the drawing inhibition flag of the N-th cassette (S608). If the drawing inhibition flag of the N-th cassette is ON, then the control unit 300 instructs the operation unit 330 to display a drawing inhibition message that inhibits the drawing of the N-th cassette (S609). If the drawing inhibition flag of the N-th cassette is OFF, then the control unit 300 instructs the operation unit 330 to delete the drawing inhibition message for the N-th cassette (S610).

Then the control unit 300 increments the value of N by 1 for determining whether to display a message on the amount of remaining sheets of the next cassette (S611). The control unit 300 then returns to the step S602, compares the value of N with the number of the cassettes of the image forming apparatus 100, and performs the same operations (S603 to S611) for the next cassette if the value of N is equal to or smaller than the number of the cassettes. With this operation, the drawing inhibition message is displayed for each cassette, among the cassettes of the image forming apparatus 100, that is determined to display the information that inhibits drawing of that cassette on the screen used for performing the setting of the cassettes.

Figure 12:
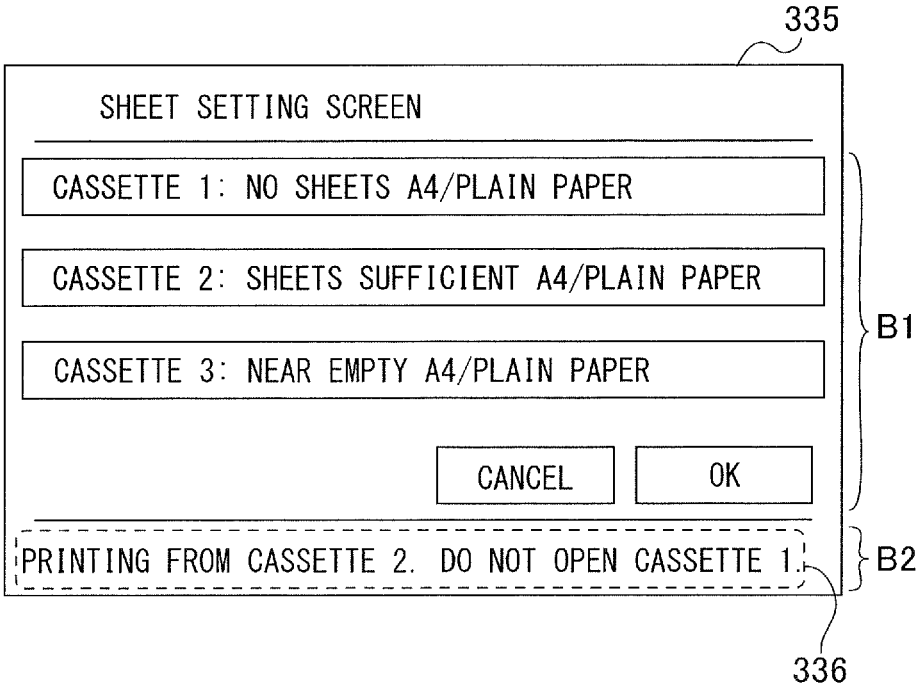
FIG. 12 is a diagram illustrating an example of a sheet setting screen of the present embodiment.

For example, in the second display process, the drawing inhibition message for inhibiting drawing of a cassette is displayed on a sheet setting screen 335 of the operation unit 330, as illustrated in FIG. 12. The sheet setting screen 335 is an example of a second screen used to display information on each cassette. Each bar of a cassette information display section B1 displays information on the amount of remaining sheets, in accordance with an instruction in the step S604, S606, or S607. In addition, each bar displays setting information (size and type) on sheets stored in a corresponding cassette. When any one of the bars is pressed, the sheet setting screen 335 changes to a screen used to change the setting information. Note that when a predetermined operation, such as pressing the sheet setting button al (FIG. 10), is performed in the home screen 331, the home screen 331 changes to the sheet setting screen 335.

When the drawing inhibition flag of any cassette is ON in the sheet setting screen 335, the drawing inhibition message is displayed as illustrated in FIG. 12. Specifically, a message 336 that inhibits drawing of a corresponding cassette is displayed in a message section B2, which is disposed below the cassette information display section B1. Thus, when an image forming job is being performed using sheets from the second feeding cassette 250 for example, and a user operates the operation unit 330 and causes the operation unit 330 to display the sheet setting screen 335, the message 336 that inhibits drawing of the first feeding cassette 150 is displayed on the sheet setting screen 335. Thus, even if the message that the amount of remaining sheets of the first feeding cassette 150 is near-empty or the message that the first feeding cassette 150 is empty is being displayed in the cassette information display section B1, the drawing inhibition message can guide a user to draw the first feeding cassette 150 after the completion of the image forming job. With this operation, the possibility that the user carelessly opens an upper cassette, disposed above a cassette that is feeding sheets, and causes sheet jam can be reduced.

Figure 13:
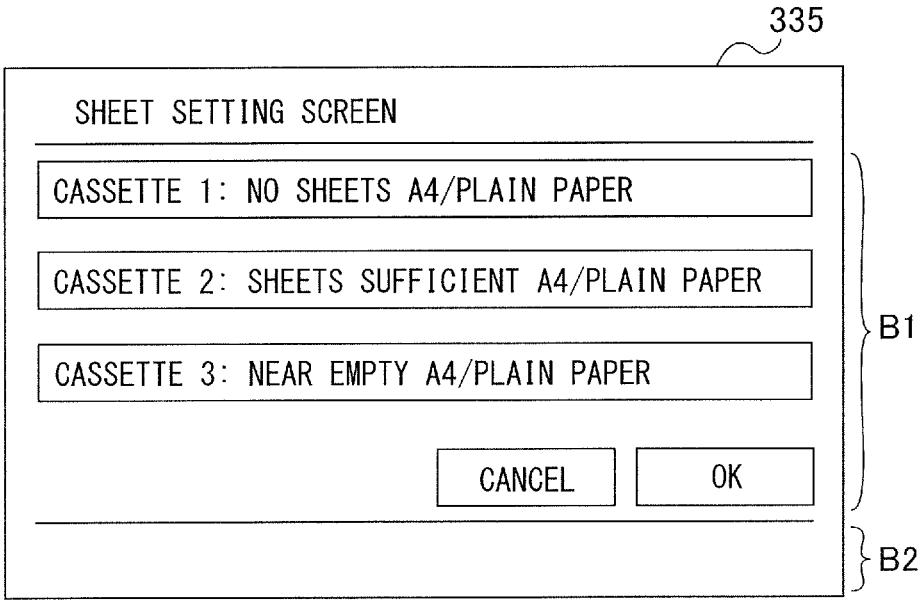
FIG. 13 is a diagram illustrating another example of the sheet setting screen of the present embodiment.

On the other hand, when an image forming job is being performed using sheets from the first feeding cassette 150 for example, the drawing inhibition message for the second feeding cassette 250 is not displayed, as illustrated in FIG. 13. Thus, a user can draw a lower cassette, disposed below a cassette that is feeding sheets, depending on the message on the amount of remaining sheets displayed on the sheet setting screen 335, and supply sheets.

In the present embodiment, the drawing inhibition message for a cassette that is feeding sheets is not displayed. However, the drawing inhibition message for the cassette that is feeding sheets may also be displayed. In this case, in the display-method determination process illustrated in FIG. 7, a process to set an ON value to the drawing inhibition flag of the L-th cassette (i.e., cassette that is feeding sheets) may be performed immediately after the step S403.

SUMMARY OF THE PRESENT EMBODIMENT

As described above, in the present embodiment, when sheets are being fed from a lower feeding cassette for an image forming job, any message on the amount of remaining sheets of an upper feeding cassette disposed above the lower feeding cassette is not displayed on the home screen 331 even if the upper cassette is empty or the amount of remaining sheets of the upper cassette is near-empty. In other words, if the second feeding portion starts to feed a sheet when the display unit is in a state of displaying the first information, the control unit 300 causes the display unit to delete the first information and display the first information after the second feeding portion feeds the sheet through the first conveyance path. The first information is information on the amount of remaining sheets of the first cassette (specifically, information indicating that the amount of remaining sheets of the first cassette is less than a predetermined reference value or is zero). In addition, "the state of displaying the first information" refers to a state of the display unit displaying the first information on at least one screen, such as the home screen 331 of the present embodiment, when the second feeding portion is not feeding sheets. With this operation, the possibility that a user opens a cassette carelessly and causes sheet jam can be reduced.

In addition, in the present embodiment, in a case where sheets are being fed from a lower feeding cassette for an image forming job, the drawing inhibition message is displayed for inhibiting the drawing of an upper feeding cassette. For example, during the second feeding portion is feeding sheets, the display unit displays information that inhibits the drawing of the first cassette. Also with this configuration, the possibility that a user carelessly opens a cassette and causes sheet jam can be reduced.

Modifications

In the above-described embodiment, when sheets are being fed from a lower feeding cassette, the message on the amount of remaining sheets of an upper feeding cassette is deleted on a screen other than the sheet setting screen 335, and the drawing inhibition message for the upper feeding cassette is displayed on the sheet setting screen 335. However, even when either one of the two functions is used, it can prevent a user from opening a cassette carelessly. Thus, even when only one function of the first display process and the second display process of the above-described embodiment is implemented in the image forming apparatus, it can reduce the possibility of occurrence of sheet jam.

As described above, in the present embodiment, when sheets are being fed from a lower feeding cassette, the drawing inhibition message is displayed on the display unit for inhibiting drawing of an upper feeding cassette. However, instead of displaying the drawing inhibition message on the display unit, the following method may be used for inhibiting drawing of a feeding cassette. For example, a light emitting portion such as an LED may be disposed on an upper feeding cassette to notify a user of whether the cassette can be drawn. In this case, the light emitting portion notifies a user that the upper feeding cassette is inhibited from being drawn, by changing a light emitting state of the light emitting portion. Specifically, in a case where such a notifying method is used, when sheets are being fed from a lower feeding cassette and the amount of remaining sheets of an upper feeding cassette is near-empty or zero, the light emitting state of the light emitting portion disposed on the upper feeding cassette is changed to a state different from a normal state. With this operation, the inhibition of drawing of the upper cassette is notified to the user. Note that when such a light emitting portion is disposed on a feeding cassette to notify a user of whether the feeding cassette can be drawn, the light emitting portion is preferably disposed closer to a handle of the feeding cassette.

In addition, in FIG. 1, a user accesses the feeding cassettes 150, 250, and 350, the operation unit 330, the outer discharging tray 200, and the upper discharging tray 197 from a front side of the image forming apparatus 100, that is, from a front side with respect to FIG. 1. Instead of this, the image forming apparatus 100 may be configured such that the front direction of the image forming apparatus 100 is equal to the sheet discharging direction (i.e., right direction in FIG. 1) toward which sheets are discharged from the upper discharging tray 197. In this case, it is preferable that the drawing direction of the feeding cassettes 150, 250, and 350 is equal to the right direction in FIG. 1, and that the display of the operation unit 330 faces toward the right direction in FIG. 1. That is, in a so-called horizontal-conveyance image forming apparatus in which an image forming portion is disposed along the main conveyance path 165 that extends substantially horizontally as illustrated in FIG. 1, the image forming apparatus may have a front loading and front discharging system. In this configuration, the intermediate paths 155 and 255 of the feeding cassettes 150 and 250 are positioned downstream in the drawing direction of the feeding cassettes 150 and 250 (that is, closer to the handles of the feeding cassettes 150 and 250).

As described above, in the present embodiment, the image forming apparatus includes a plurality of cassettes that are arranged vertically. However, this technique can also be applied to another image forming apparatus in which a sheet fed from one cassette is conveyed through a conveyance path formed in another cassette. For example, this technique can also be applied to an image forming apparatus in which a plurality of cassettes is arranged horizontally.

This technique can reduce the possibility that a user draws a cassette carelessly and causes sheet jam, without providing a lock mechanism that locks a cassette on the apparatus body. However, the technique may be used together with the lock mechanism. In this case, even when the lock mechanism fails, the possibility that a user opens a cassette carelessly and causes sheet jam can be reduced by this technique. Thus, the occurrence of sheet jam can be more reliably avoided.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-014163, filed on Jan. 30, 2019, which is hereby incorporated by reference herein in its entirety.

What is claimed is:

1. An image forming apparatus comprising:

an apparatus body provided with an image forming portion configured to form an image on a sheet;

a first feeding portion comprising a first cassette and a first feed roller configured to feed a sheet stored in the first cassette toward the image forming portion;

a second feeding portion disposed below the first feeding portion and comprising a second cassette and a second feed roller configured to feed a sheet stored in the second cassette, the sheet fed by the second feed roller being conveyed toward the image forming portion through an intermediate path provided in the first cassette;

a first detection portion configured to detect an amount of remaining sheets stored in the first cassette;

a display unit configured to display a first screen and a second screen, wherein the display unit is configured to display the second screen to display information related to the first cassette if a predetermined operation is performed in a state where the first screen is being displayed; and a controller configured to operate the display unit to display information that inhibits drawing of the first cassette on the second screen, in a case where the first detection portion detects that the first cassette is empty and where the second feeding portion is performing a sheet feeding operation, with the first cassette being drawable from the apparatus body whether the second feeding portion is performing a sheet operation or not.

2. The image forming apparatus according to claim 1, further comprising a third feeding portion disposed below the second feeding portion and comprising a third cassette and a third feed roller configured to feed a sheet stored in the third cassette, the sheet fed by the third feed roller being conveyed toward the image forming portion through an intermediate path provided in the second cassette, wherein the controller is configured to operate the display unit to display information that inhibits drawing of the first cassette and the second cassette, each of which is drawable from the apparatus body whether the third feeding portion is performing a sheet feeding operation or not, in a case where the third feeding portion is performing a sheet feeding operation.

3. The image forming apparatus according to claim 1, wherein the controller is configured to operate the display unit not to display information that inhibits drawing of the second cassette, in a case where the first feeding portion is performing a sheet feeding operation.

4. The image forming apparatus according to claim 1, wherein in a case where the second feeding portion starts the sheet feeding operation in a state where the display unit is displaying the second screen, the controller operates the display unit to display the information that inhibits drawing of the first cassette on the second screen while keeping the display unit to display the information related to the first cassette.

5. The image forming apparatus according to claim 4, wherein the controller is configured to operate the display unit to display first information related to the amount of remaining sheets stored in the first cassette, depending on a detection result by the first detection portion, and wherein in a case where the second feeding portion starts the sheet feeding operation in a state where the display unit is displaying the first screen that contains the first information, the controller operates the display unit to delete the first information from the first screen.

6. The image forming apparatus according to claim 5, wherein the first information is information indicating that the first cassette is empty or that the amount of remaining sheets stored in the first cassette is less than a predetermined reference value.

7. The image forming apparatus according to claim 1, further comprising a second detection portion configured to detect an amount of remaining sheets stored in the second cassette, wherein the controller is configured to operate the display unit to display second information related to the amount of remaining sheets stored in the second cassette, depending on a detection result by the second detection portion, and wherein in a case where the first feeding portion starts a sheet feeding operation in a state where the display unit is displaying the second information, the controller operates the display unit to keep displaying the second information.

8. The image forming apparatus according to claim 1, wherein the controller is configured to operate the display unit not to display the information that inhibits drawing of the first cassette, in a case where the first detection portion detects a remaining sheet is present in the first cassette.

9. The image forming apparatus according to claim 1, wherein the controller is configured to operate the display unit to display first information related to the amount of remaining sheets stored in the first cassette, depending on a detection result by the first detection portion, and wherein in a case where the second feeding portion starts the sheet feeding operation in a state where the display unit is displaying the first screen that contains the first information, the controller operates the display unit to delete the first information from the first screen.

10. The image forming apparatus according to claim 9, wherein the first information is information indicating that the first cassette is empty or that the amount of remaining sheets stored in the first cassette is less than a predetermined reference value.

11. An image forming apparatus comprising:

an apparatus body provided with an image forming portion configured to form an image on a sheet;

a first feeding portion comprising a first cassette configured to be drawable with respect to the apparatus body and a first feed roller configured to feed a sheet stored in the first cassette toward the image forming portion;

a second feeding portion disposed below the first feeding portion and comprising a second cassette and a second feed roller configured to feed a sheet stored in the second cassette, the sheet fed by the second feed roller being conveyed toward the image forming portion through an intermediate path provided in the first cassette;

a display unit configured to display a first screen and a second screen, wherein the display unit is configured to display the second screen to display information related to the first cassette if a predetermined operation is performed in a state where the first screen is being displayed; and a controller configured to operate the display unit to display information that inhibits drawing of the first cassette on the second screen, in a case where the first cassette is drawable with respect to the apparatus body and where the second feeding portion is performing a sheet feeding operation.

12. The image forming apparatus according to claim 11, further comprising a third feeding portion disposed below the second feeding portion and comprising a third cassette and a third feed roller configured to feed a sheet stored in the third cassette, the sheet fed by the third feed roller being conveyed toward the image forming portion through an intermediate path provided in the second cassette which can be drawable, wherein the controller is configured to operate the display unit to display information that inhibits drawing of the first cassette and the second cassette, in a case where the first cassette and the second cassette are drawable with respect to the apparatus body and where the third feeding portion is performing a sheet feeding operation.

13. The image forming apparatus according to claim 11, wherein the controller is configured to operate the display unit not to display information that inhibits drawing of the second cassette, in a case where the first feeding portion is performing a sheet feeding operation.

14. The image forming apparatus according to claim 11, wherein the controller is configured to operate the display unit to display first information related to the amount of remaining sheets stored in the first cassette, and wherein in a case where the second feeding portion starts the sheet feeding operation in a state where the display unit is displaying the first screen that contains the first information, the controller operates the display unit to delete the first information from the first screen.

15. The image forming apparatus according to claim 14, wherein the first information is information indicating that the first cassette is empty or that the amount of remaining sheets stored in the first cassette is less than a predetermined reference value.

* * * * *